US006307529B1

(12) United States Patent
Ryeom et al.

(10) Patent No.: US 6,307,529 B1
(45) Date of Patent: Oct. 23, 2001

(54) SCAN DRIVE CIRCUIT FOR PLASMA DISPLAY PANEL

(75) Inventors: Jeong-duk Ryeom, Chunan; Kwang-hoon Jeon, Suwon; Kyoung-ho Kang, Asan, all of (KR)

(73) Assignee: Samsung Display Devices, Ltd., Kyungki-Do (KR)

( * ) Notice: Subject to any disclaimer, the term of this patent is extended or adjusted under 35 U.S.C. 154(b) by 0 days.

(21) Appl. No.: 09/335,492

(22) Filed: Jun. 18, 1999

(30) Foreign Application Priority Data

Sep. 28, 1998 (KR) ..... 98-40281

(51) Int. Cl.[7] ..... G09G 3/28
(52) U.S. Cl. ..... 345/60
(58) Field of Search ..... 345/60, 68, 62, 345/66, 210; 315/169.1, 169.4, 168

(56) References Cited

U.S. PATENT DOCUMENTS 6,111,556 * 8/2000 Moon ..... 345/68
6,144,163 * 11/2000 Amemiya et al. ..... 315/169.1
6,144,348 * 11/2000 Kanazawa et al. ..... 345/60
6,144,349 * 11/2000 Awata et al. ..... 345/60

* cited by examiner

*Primary Examiner*—Richard Hjerpe
*Assistant Examiner*—Ronald Laneau
(74) *Attorney, Agent, or Firm*—Lowe Hauptman Gilman & Berner, LLP

(57) ABSTRACT

A scan drive circuit of a plasma display panel in which first and second voltages are applied to the corresponding scan electrode lines during different reset and address periods in accordance with an input timing control signal and a third voltage for a sustain discharge is alternately applied to the corresponding scan electrode lines during a period other than the different reset and address periods, the scan drive circuit including a power switching circuit for outputting two voltages to be simultaneously used among the first, second and third voltages in accordance with the timing control signal, and line switching circuits connected to input ports of the corresponding scan electrode lines, for outputting one of the two voltages input from the power switching circuit to the corresponding scan electrode lines in accordance with the timing control signal.

6 Claims, 8 Drawing Sheets

SCAN DRIVE CIRCUIT FOR PLASMA DISPLAY PANEL

BACKGROUND OF THE INVENTION

1. Field of the Invention

The present invention relates to a scan drive circuit for a plasma display panel, and more particularly, to a scan drive circuit suitable to an address-while-display driving method.

2. Description of the Related Art

FIG. 1 is a diagram showing a electrode line pattern of a general plasma display panel and FIG. 2 is a schematic section view of a cell forming a pixel of the plasma display panel shown in FIG. 1. Referring to the drawings, a general surface-discharge plasma display panel includes address electrode lines A1, A2, A3, . . . and Am, a first dielectric layer 21, phosphors 22, scan electrode lines Y1, Y2, . . . , Yn−1 and Yn (231 and 232 in FIG. 2), common electrode lines X (241 and 242 in FIG. 2), a second dielectric layer 25 and a protective film 26. The respective scan electrode lines Y1, Y2, . . . , Yn−1 and Yn are comprised of a scanning indium tin oxide (ITO) electrode line 231 and a scanning bus electrode line 232, as shown in FIG. 2. Similarly, the common electrode lines X are comprised of a common ITO electrode line 241 and a common bus electrode line 242. A gas for forming plasma is hermetically sealed in a space between the protective film 26 and the first dielectric layer 21.

The address electrode lines A1, A2, A3, . . . and Am are coated on a lower substrate (not shown) as a first substrate in a predetermined pattern. The first dielectric layer 21 is entirely coated over the address electrode lines A1, A2, A3, . . . and Am. The phosphors 22 are coated on the first dielectric layer 21 in a predetermined pattern. In some cases, the first dielectric layer 21 may not be formed. Instead, the phosphors 22 may be coated over the address electrode lines A1, A2, A3, . . . and Am in a predetermined pattern. The scan electrode lines Y1, Y2, . . . , Yn−1, 231 and 232 and the common electrode lines X, 241 and 242 are arranged on an upper substrate (not shown) as a second substrate to be orthogonal to the address electrode lines A1, A2, A3, . . . and Am in a predetermined pattern. The respective intersections define corresponding pixels. The second dielectric layer 25 is entirely coated over the scan electrode lines Y1, Y2, . . . , Yn−1, 231 and 232 and the common electrode lines X, 241 and 242. The protective film 26 for protecting the panel against a strong electrical field is entirely coated over the second dielectric layer 25.

A general driving circuit of the plasma display panel is illustrated in FIG. 3. Referring to FIG. 3, the general driving circuit of a plasma display panel 31 includes a controller 34, a scan drive circuit 35, a common drive circuit 33 and an address drive circuit 32. The controller 34 generates a timing control signal corresponding to input image data to apply the same to the scan drive circuit 35, the common drive circuit 33 and the address drive circuit 32. The scan drive circuit 35 applies drive signals to the corresponding scan electrode lines Y1, Y2, . . . and Yn in accordance with the timing control signal generated from the controller 34. The common drive circuit 33 applies driving signals to the corresponding common electrode lines X in accordance with the timing control signal generated from the controller 34. The address drive circuit 32 applies an image data signal to the corresponding address electrode lines A1, A2, . . . and Am in accordance with the timing control signal generated from the controller 34.

The driving methods generally adopted to the plasma display panel described above are an address/display separation driving method and an address-while-display driving method. In the address/display separation driving method, a reset step, an address step and a sustain discharge step are sequentially performed on all scan electrode lines. On the other hand, in the address-while-display driving method, a reset step, an address step and a sustain discharge step are individually performed on each scan electrode line, irrespective of the arranged order of the scan electrode lines. Thus, according to the address-while-display driving method, a discharge sustain period is longer that in the address/display separation driving method, thereby enhancing the display luminance.

FIG. 4 shows a conventional scan drive circuit adopting the address/display separation driving method in the driving circuit shown in FIG. 3. Referring to FIG. 4, in the conventional scan drive circuit, voltages V1, V2, V3, V4 and Vg are used, and switching elements S11, S12, S13, S14, S15, . . . are connected to input ports of the scan electrode lines Y1, Y2, . . . and Yn, respectively. Here, the number of the switching elements S11, S12, S13, S14 and S15 connected to the scan electrode line Y1, that is, 5, is the same as the number of the voltages to be used. This is for individually performing the reset step, the address step and the sustain discharge step for the respective scan electrode lines Y1, Y2, . . . and Yn of the plasma display panel according to the address-while-display driving method. Thus, in the above-described conventional scan drive circuit, since as many switching elements as the voltages to be used are connected to the input ports of the respective scan electrode lines Y1, Y2, . . . and Yn, the hardware becomes bulky due to many switching elements. For example, when the number of voltages to be used is 5 and the number of scan electrode lines is 480, 2,400 switching elements are necessary for driving the scan electrode lines. This problem is aggravated for a high definition plasma display panel having many scan electrode lines.

SUMMARY OF THE INVENTION

To solve the above problem, it is an objective of the present invention to provide a scan drive circuit of a plasma display panel which can relatively reduce the number of necessary scan driving switching elements while adopting an address-while-display driving method.

Accordingly, to achieve the above objective, there is provided a scan drive circuit of a plasma display panel in which first and second voltages are applied to the corresponding scan electrode lines during different reset and address periods in accordance with an input timing control signal and a third voltage for a sustain discharge is alternately applied to the corresponding scan electrode lines during a period other than the different reset and address periods, the scan drive circuit including a power switching circuit for outputting two voltages to be simultaneously used among the first, second and third voltages in accordance with the timing control signal, and line switching circuits connected to input ports of the corresponding scan electrode lines, for outputting one of the two voltages input from the power switching circuit to the corresponding scan electrode lines in accordance with the timing control signal.

Therefore, while adopting the address-while-display driving method, the scan drive circuit can relatively reduce the number of scan driving switching elements. In the present invention, only two switching elements are used for each line switching circuit.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENT

Figure 1:
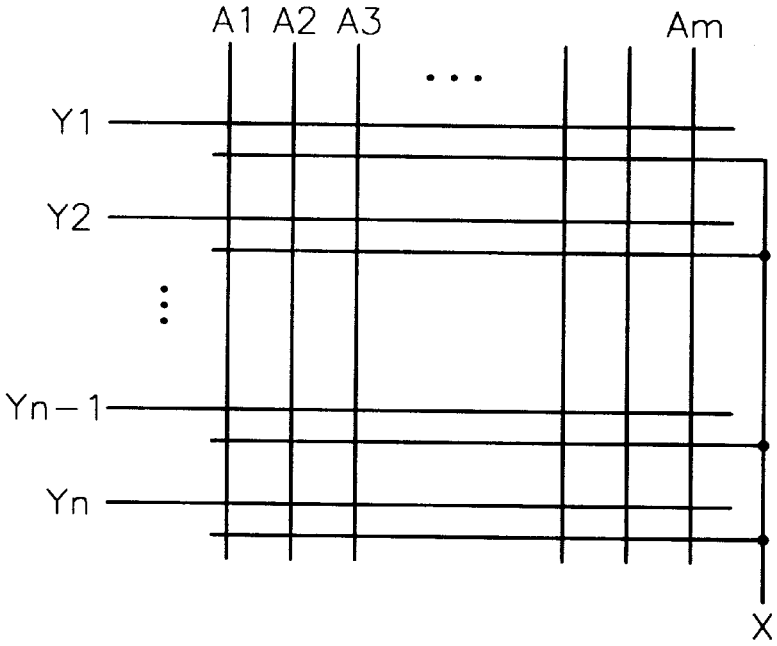
FIG. 1 is an electrode line pattern diagram of a general plasma display panel.
Figure 2:
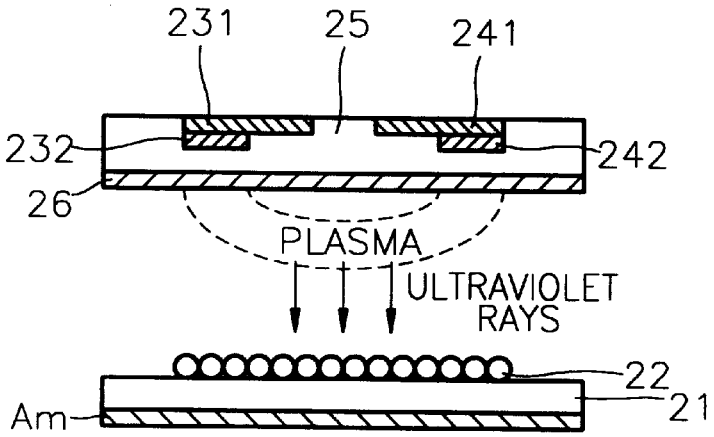
FIG. 2 is a schematic section view of a cell forming a pixel of the plasma display panel shown in FIG. 1.
Figure 3:
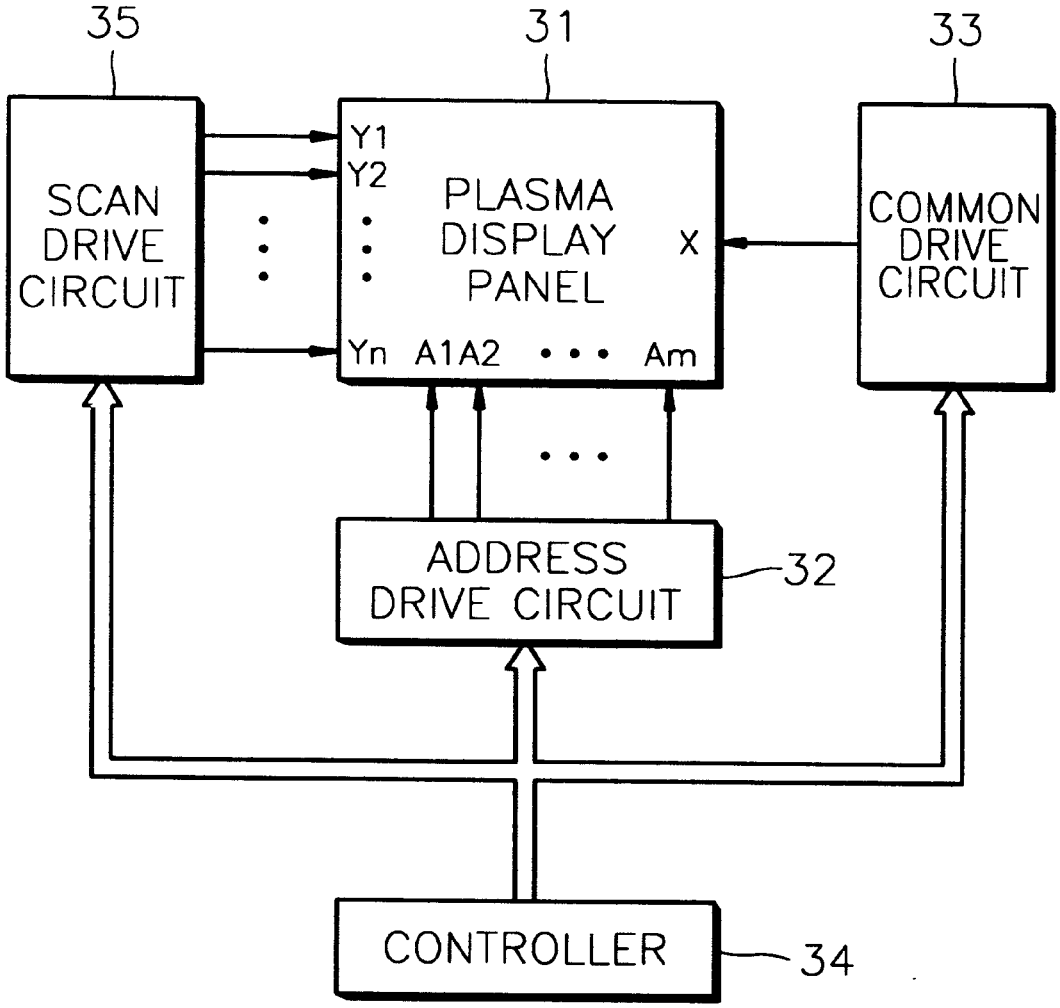
FIG. 3 is a block diagram of a general driving circuit of a plasma display panel.
Figure 4:
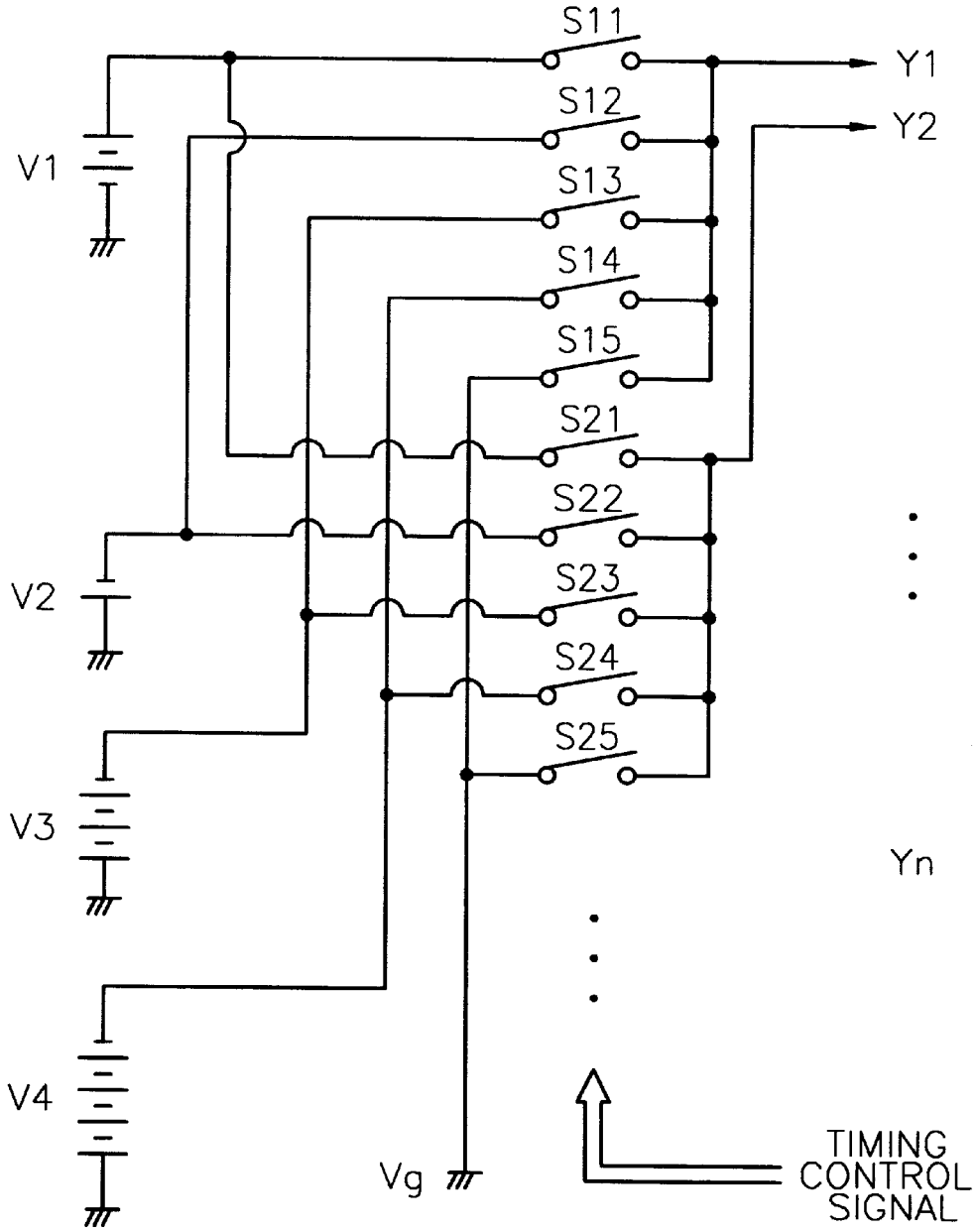
FIG. 4 (PRIOR ART)
FIG. 4 is a diagram showing a conventional scan drive circuit adopting an address/display separation driving method in the driving circuit shown in FIG. 3.
Figure 5:
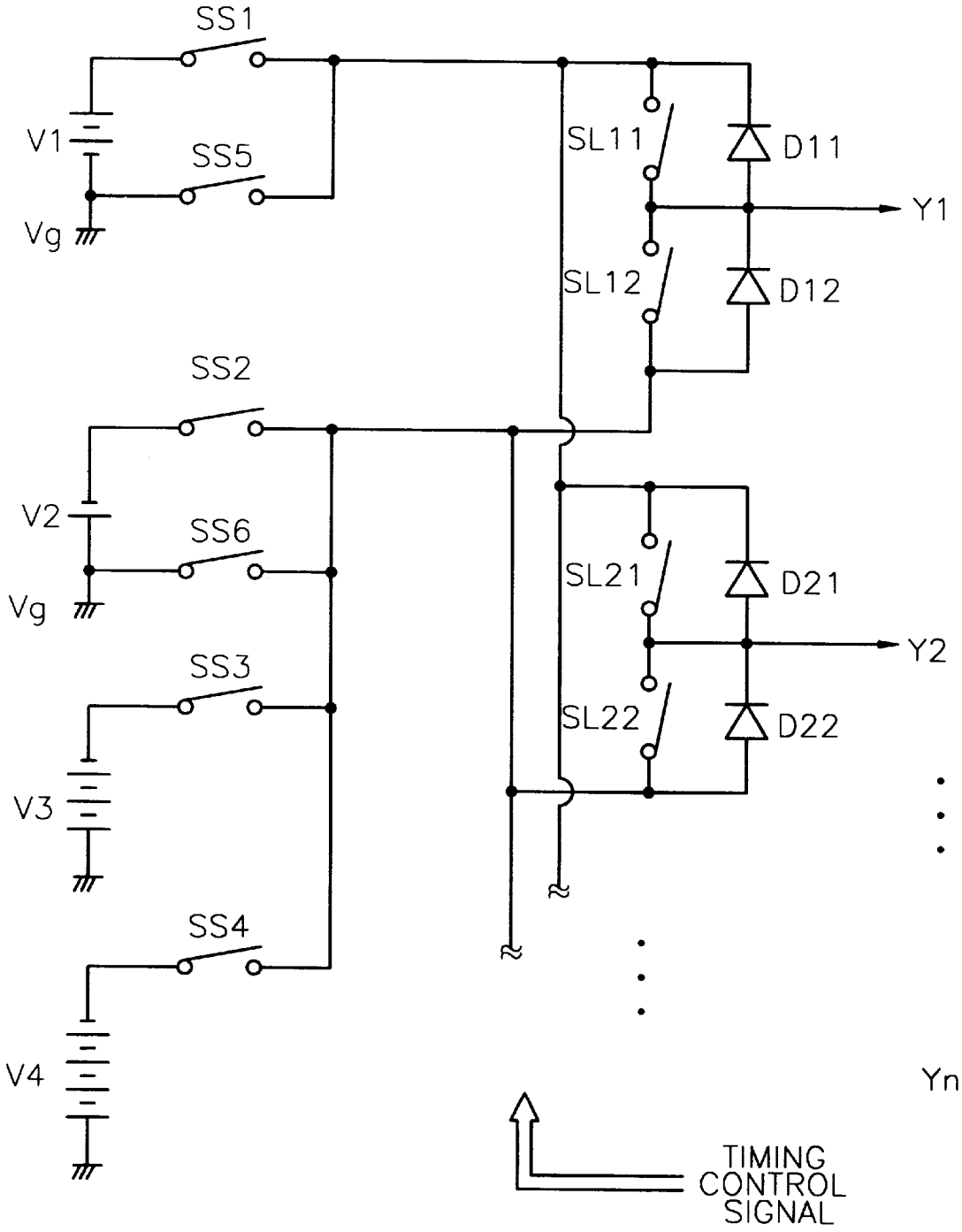
FIG. 5 is a diagram showing a scan drive circuit adopting an address/display separation driving method in the driving circuit shown in FIG. 3, according to a first embodiment of the present invention.

FIG. 5 is a diagram showing a scan drive circuit adopting an address/display separation driving method in the driving circuit shown in FIG. 3, according to a first embodiment of the present invention. Referring to FIG. 5, a scan drive circuit according to the present invention includes power switching circuits SS1, . . . and SS6, and line switching circuits SL11, SL12, SL21, SL22, . . . , D11, D12, D21, D22, . . . where diodes D11, D12, D21, D22, . . . are provided for the purpose of performing a rapid discharge through the corresponding scan electrode lines Y1, Y2, . . . and Yn while the SS5 or SS6 line switching element for switching a ground voltage Vg is 'ON'. The power switching circuits SS1, . . . SS6 outputs two voltages to be simultaneously used among the voltages V1, V2, V3, V4 and Vg in accordance with the timing control signal generated from the controller (34 of FIG. 3). The respective line switching circuits SL11, SL12, SL21, SL22, . . . , D11, D12, D21, D22, . . . connected to the input ports of the corresponding scan electrode lines Y1, Y2, . . . and Yn output one of the two voltages input from the power switching circuits SS1, . . . and SS6 to the corresponding scan electrode lines Y1, Y2, . . . and Yn in accordance with the timing control signal generated from the controller 34. Accordingly, while the address-while-display driving method can be adopted, the number of the scan driving switching elements SS1, . . . SS6, SL11, SL12, SL21, SL22, . . . can be relatively reduced. In the respective line switching circuits SL11, SL12, SL21, SL22, . . . , D11, D12, D21, D22, . . . , only two switching elements are used. Thus, when the number of the scan electrode lines is 480, 966, i.e., 6+(2×480), scan driving switching elements are necessary. That is to say, compared to the 2,400 scan driving switching elements used in the conventional scan drive circuit (see FIG. 4), the number of the switching elements can be reduced by 1,434. The respective line switching circuits SL11, SL12, SL21, SL22, . . . , D11, D12, D21, D22, . . . are connected to the corresponding scan electrode lines Y1, Y2, . . . and Yn through their output ports, and include first line switching elements SL11, SL21, . . . and second line switching elements LS12, LS22, . . . to the input ports of which two voltages output from the power switching circuits SS1, . . . and SS6.

Among the power switching circuits SS1, . . . and SS6, the first power switching element SS1 has an input port to which a first voltage V1 is applied and an output port connected to the input ports of the first line switching elements SL11, SL21, . . . The first power switching element SS2 has an input port to which a second voltage V2 is applied and an output port connected to the input ports of the second line switching elements SL12, SL22, . . . The third power switching element SS3 has an input port to which a third voltage V3 is applied and an output port connected to the output port of the second power switching element SS2. The fourth power switching element SS4 has an input port to which a fourth voltage V4 is applied and an output port connected to the output port of the third power switching element SS3. The fifth power switching element SS5 has an input port grounded and an output port connected to the output port of the first power switching element SS1. The sixth power switching element SS6 has an input port grounded and an output port connected to the output port of the second power switching element SS2. Of two voltages output from the power switching elements SS1, . . . and SS6, one is a voltage selected from a positive voltage V1 and a ground voltage Vg, and the other is a voltage selected from negative voltages V2, V3 and V4 and the ground voltage Vg.

Figure 6:
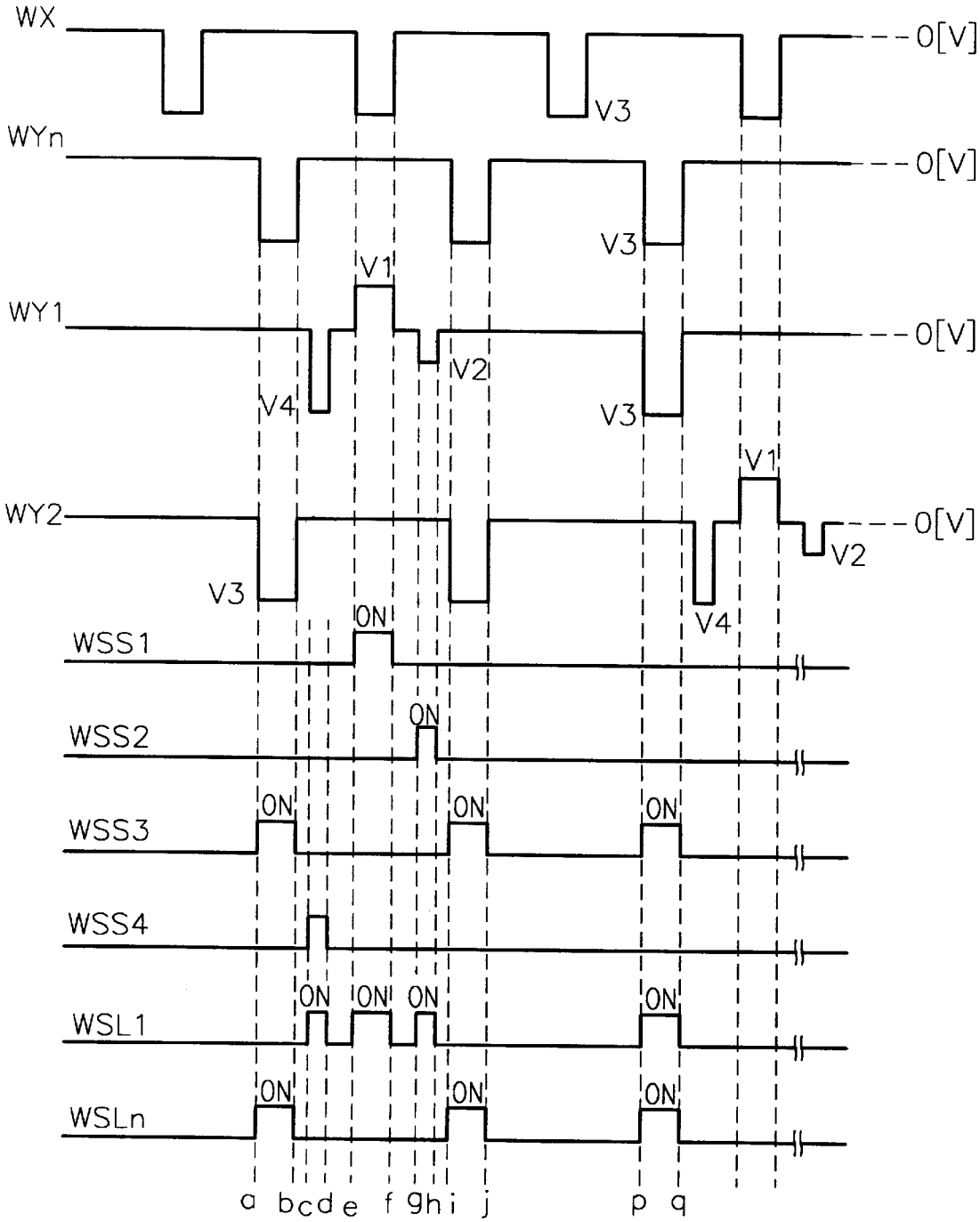
FIG. 6 shows waveforms of a timing control signal and driving voltages used in the scan drive circuit shown in FIG. 5.

FIG. 6 shows waveforms of a timing control signal and driving voltages used in the scan drive circuit shown in FIG. 5. In FIG. 6, reference mark WX denotes a waveform of a driving voltage applied from the common drive circuit (33 of FIG. 3) to the common electrode lines X, WYn denotes a waveform of a driving voltage applied to the n-th scan electrode line Yn, WY1 denotes a waveform of a driving voltage applied to the first scan electrode line Y1, WY2 denotes a waveform of a driving voltage applied to the second scan electrode line Y2, WSS1 denotes a waveform of a timing control signal input to the first power switching element (SS1 of FIG. 5), WSS2 denotes a waveform of a timing control signal input to the second power switching element (SS2 of FIG. 5), WSS3 denotes a waveform of a timing control signal input to the third power switching element (SS3 of FIG. 5), WSS4 denotes a waveform of a timing control signal input to the fourth power switching element (SS4 of FIG. 5), WSL1 denotes a composite waveform of timing control signals input to the first line switching elements (SL11 and SL12 of FIG. 5), and WSLn denotes a composite waveform of timing control signals input to the n-th line switching elements.

Referring to FIGS. 5 and 6, the third voltage V3 for use in a sustain discharge is negative. The first, second and fourth voltages V1, V2 and V4 are alternately applied to the scan electrode lines corresponding to different reset and address period, e.g., a period c-h in the case of the first scan electrode line Y1. The first voltage V1 having a positive polarity is applied for the first time during different address periods, e.g., a time period e-h in the case of the first scan electrode line Y1. Since the third voltage V3 having a negative polarity is applied to the common electrode lines X for the period during which the first voltage V1 is applied, e.g., a time period e-f in the case of the first scan electrode line Y1 (the waveform WX of FIG. 6), wall charges are generated within the corresponding pixels. Also, since the negative second voltage V2 is applied to the corresponding scan electrode line for the following time period, e.g., a time period g-h in the case of the first scan electrode line Y1 and the ground voltage Vg, i.e., 0 V, is applied to the common electrode lines X, the wall charges generated by the first voltage V1 are accumulated in the selected pixels. Since the negative fourth voltage V4 is applied to the corresponding scan electrode line during a reset period, e.g., a time period c-d in the case of the first scan electrode line Y1 and the ground voltage Vg, i.e., 0 V, is applied to the common electrode lines X, the residual wall charges of the previous sub-field are erased.

Figure 7:
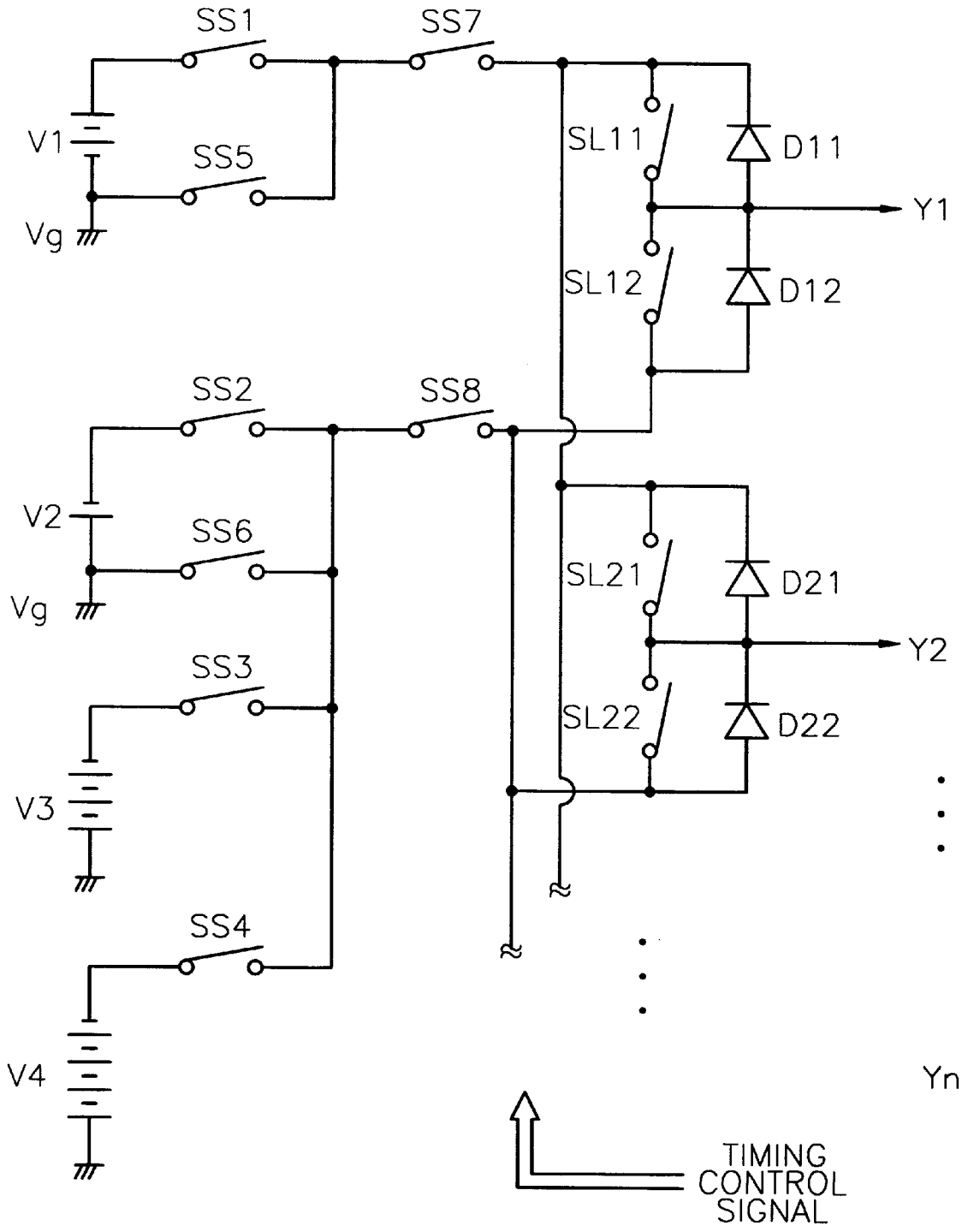
FIG. 7 is a diagram showing a second embodiment of a scan drive circuit according to the present invention.

FIG. 7 is a diagram showing a second embodiment of a scan drive circuit according to the present invention. The scan drive circuit shown in FIG. 7 further includes seventh and eighth power switching elements SS7 and SS8, compared to that shown in FIG. 5. In FIG. 7, the same reference marks as those in FIG. 5 denote the same elements. Referring to FIG. 6, the seventh power switching element SS7 is connected between the output port of the first power switching element SS1 and the input ports of the first line switching elements SL11, SL21, . . . The eighth power switching element SS8 is connected between the output port of the second power switching element SS2 and the input ports of the second line switching elements SL12, SL22, . . .

Figure 8:
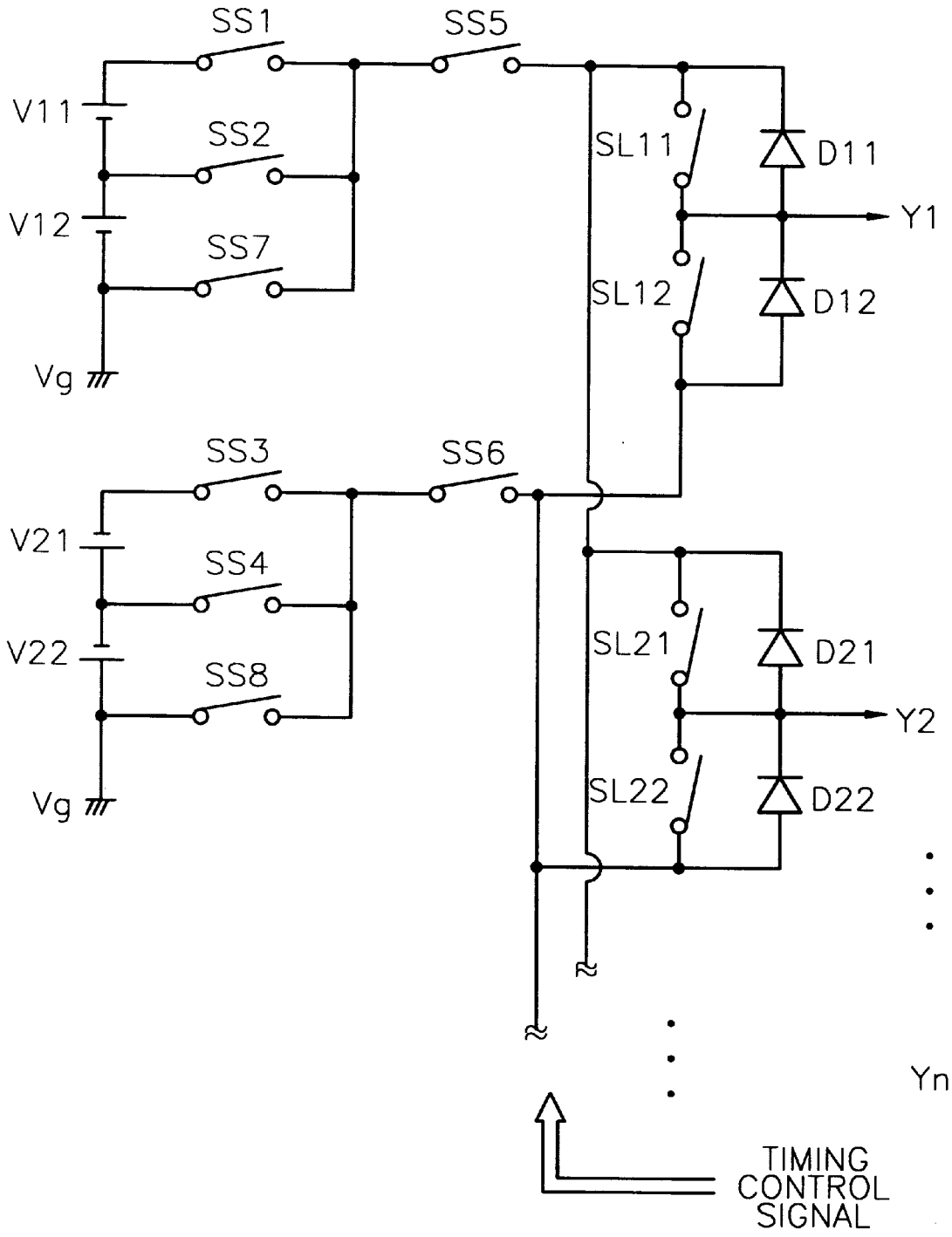
FIG. 8 is a diagram showing a third embodiment of a scan drive circuit according to the present invention.

FIG. 8 is a diagram showing a third embodiment of a scan drive circuit according to the present invention. In the respective line switching circuits SL11, SL12, SL21, SL22, . . . , D11, D12, D21, D22, . . . shown in FIG. 8, the same reference marks as those in FIG. 5 denote the same elements. In the power switching circuits SS!, . . . and SS8, when the fifth power switching element SS5 is 'OFF', the input ports of the first line switching elements SL11, SL21, . . . are floated. Similarly, when the sixth power switching element SS6 is 'OFF', the input ports of the second line switching elements SL12, SL22, . . . are floated. Thus, in order to apply a required voltage is applied to the first line switching elements SL11, SL21, . . . , the fifth power switching element SS5 must be 'ON'. Also, in order to apply a required voltage is applied to the second line switching elements SL12, SL22, . . . , the sixth power switching element SS6 must be 'ON'.

The following Table 1 shows input voltages Vx of the fifth power switching element SS5 depending on the operating state of the first, second and seventh power switching elements SS1, SS2 and SS7.

TABLE 1

| SS1 | SS2 | SS7 | Vx |
|---|---|---|---|
| 0 | 0 | 0 | Floated |
| 0 | 0 | 1 | Vg |
| 0 | 1 | 0 | V12 |
| 0 | 1 | 1 | Vg (not used) |
| 1 | 0 | 0 | V11 + V12 |
| 1 | 0 | 1 | Vg (not used) |
| 1 | 1 | 0 | V12 (not used) |
| 1 | 1 | 1 | Vg (not used) |

The following Table 2 shows input voltages Vx of the sixth power switching element SS6 depending on the operating state of the third, fourth and eighth power switching elements SS3, SS4 and SS8.

TABLE 2

| SS3 | SS4 | SS8 | Vx |
|---|---|---|---|
| 0 | 0 | 0 | Floated |
| 0 | 0 | 1 | Vg |
| 0 | 1 | 0 | V22 |
| 0 | 1 | 1 | Vg (not used) |

TABLE 2-continued

| SS3 | SS4 | SS8 | Vx |
|---|---|---|---|
| 1 | 0 | 0 | V21 + V22 |
| 1 | 0 | 1 | Vg (not used) |
| 1 | 1 | 0 | V22 (not used) |
| 1 | 1 | 1 | Vg (not used) |

Figure 9:
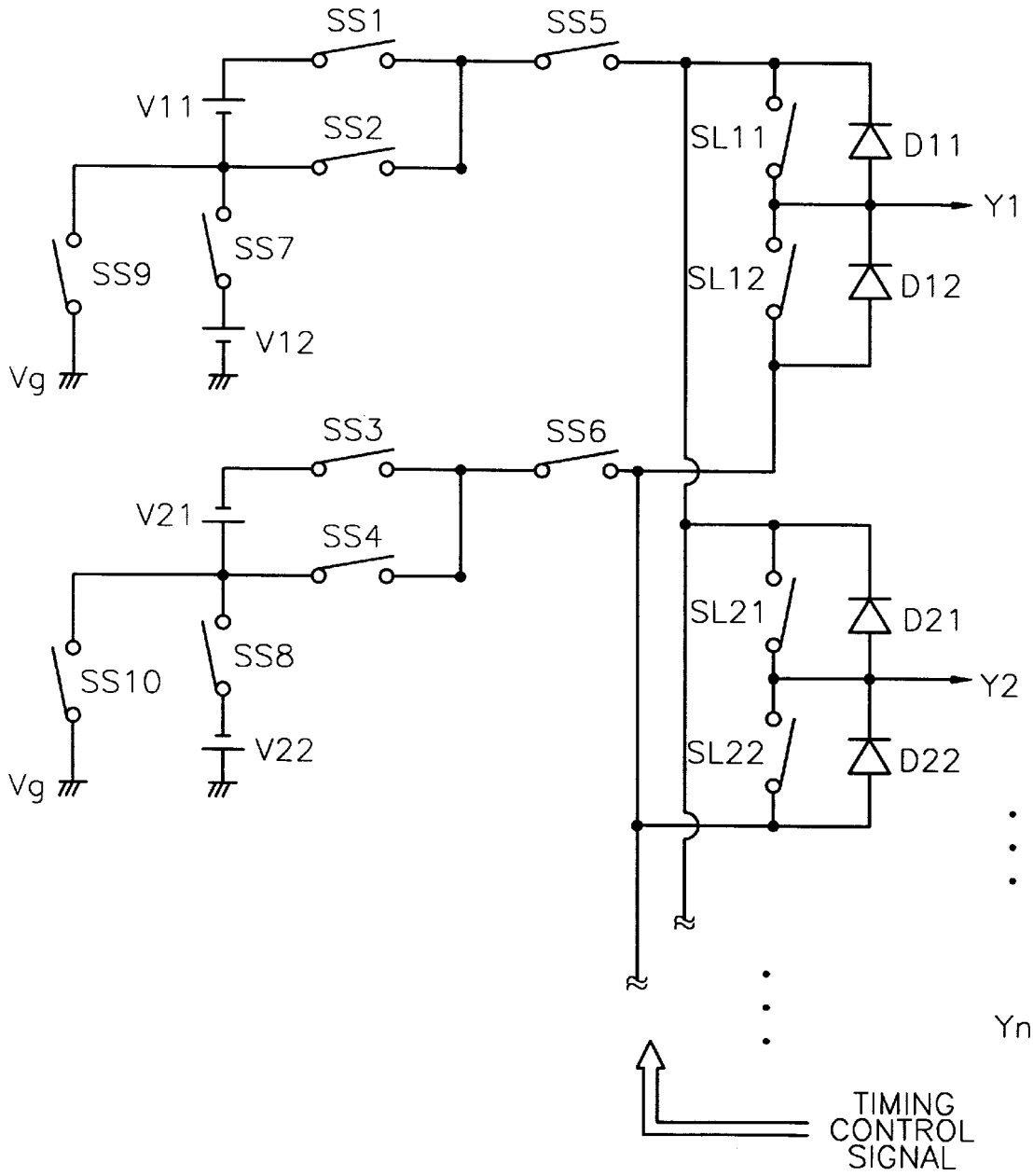
FIG. 9 is a diagram showing a fourth embodiment of a scan drive circuit according to the present invention.

FIG. 9 is a diagram showing a fourth embodiment of a scan drive circuit according to the present invention, in which the positions of the seventh and eighth power switching elements SS7 and SS8 are changed from those in the scan drive circuit shown in FIG. 8, and ninth and tenth power switching elements are further provided. Accordingly, seven kinds of voltages V11, V12, V11+V12, V21, V22, V21+V22 and Vg can be used with 5 voltages V11, V12, V21, V22 and Vg.

As described above, in the scan drive circuit of a plasma display panel according to the present invention, since the number of the scan driving switching elements is relatively reduced while an address-while-display driving method can be adopted, the volume of the hardware can be reduced.

Although the invention has been described with respect to a preferred embodiment, it is not to be so limited as changes and modifications can be made which are within the full intended scope of the invention as defined by the appended claims.

What is claimed is:

1. A scan drive circuit of a plasma display panel in which first and second voltages are applied to the corresponding scan electrode lines during different reset and address periods in accordance with an input timing control signal and a third voltage for a sustain discharge is alternately applied to the corresponding scan electrode lines during a period other than the different reset and address periods, the scan drive circuit comprising:

a power switching circuit for outputting two voltages to be simultaneously used among the first, second and third voltages in accordance with the timing control signal; and line switching circuits connected to input ports of the corresponding scan electrode lines, for outputting one of the two voltages input from the power switching circuit to the corresponding scan electrode lines in accordance with the timing control signal.

2. The scan drive circuit according to claim 1, wherein each of the line switching circuits comprises first and second line switching elements whose output ports are connected to the corresponding scan electrode lines and to input ports of which two voltages from the power switching circuit are input.

3. The scan drive circuit according to claim 2, wherein of the two voltage from the power switching circuit, one is either a positive voltage or a ground voltage, and the other is either a negative voltage or a ground voltage.

4. The scan drive circuit according to claim 1, wherein the third voltage for a sustain discharge has a negative polarity, and the voltages alternately applied to the scan electrode lines corresponding to the different reset and address periods include a first voltage having a positive polarity, applied for the first time during the address period, for forming wall charges within the corresponding pixels, a second voltage having a negative polarity, applied during the address period, for accumulating the wall charges formed by the first voltage within selected pixels, a fourth voltage having a negative polarity, applied during the reset period, for erasing the residual wall charges of the previous sub-field, and a ground voltage.

5. The scan drive circuit according to claim 4, wherein the power switching circuit comprises:

a first power switching element having an input port to which the first voltage is applied and an output port connected to input ports of the first line switching elements;

a second power switching element having an input port to which the second voltage is applied and an output port connected to input ports of the second line switching elements;

a third power switching element having an input port to which the third voltage is applied and an output port connected to an output port of the second power switching element;

a fourth power switching element having an input port to which the fourth voltage is applied and an output port connected to an output port of the third power switching element;

a fifth power switching element having an input port to which the ground voltage is applied and an output port connected to an output port of the first power switching element; and a sixth power switching element having an input port to which the ground voltage is applied and an output port connected to an output port of the second power switching element.

6. The scan drive circuit according to claim 5, further comprising:

a seventh power switching element connected between the output port of the first power switching element and input ports of the first line switching elements; and a eighth power switching element connected between the output port and input ports of the second line switching elements.

* * * * *